US007617811B2

(12) United States Patent
Neu et al.

(10) Patent No.: US 7,617,811 B2
(45) Date of Patent: Nov. 17, 2009

(54) CRANKCASE WITH ADAPTER FLANGE

(75) Inventors: Dagmar Neu, Bermatingen (DE); Georg Ruetz, Immenstaad (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 12/074,038

(22) Filed: Feb. 29, 2008

(65) Prior Publication Data

US 2008/0210193 A1 Sep. 4, 2008

(30) Foreign Application Priority Data

Mar. 1, 2007 (DE) ..... 10 2007 009 955

(51) Int. Cl.
*F02F 7/00* (2006.01)

(52) U.S. Cl. ..... 123/195 A; 123/195 C

(58) Field of Classification Search ..... 123/195 R, 123/195 A, 195 C

See application file for complete search history.

(56) References Cited

U.S. PATENT DOCUMENTS

| | | | | |
|---|---|---|---|---|
| 3,841,290 | A | 10/1974 | Schubeck | |
| 5,245,961 | A | 9/1993 | Miyakubo et al. | |
| 5,669,346 | A * | 9/1997 | Leweux et al. | 123/195 R |
| 6,415,748 | B2 | 7/2002 | Pierro et al. | |
| 6,817,335 | B2 | 11/2004 | Groddeck et al. | |
| 7,267,093 | B2 | 9/2007 | Huster et al. | |
| 2001/0015189 | A1 * | 8/2001 | Furuya et al. | 123/195 C |
| 2003/0037754 | A1 * | 2/2003 | Neal | 123/195 C |
| 2004/0011318 | A1 * | 1/2004 | Bonde et al. | 123/195 R |
| 2004/0134458 | A1 * | 7/2004 | Chiba et al. | 123/195 A |
| 2004/0159301 | A1 | 8/2004 | Huster | |

FOREIGN PATENT DOCUMENTS

| | | |
|---|---|---|
| DE | 4302062 | 7/1993 |
| DE | 4312424 | 10/1994 |
| DE | 19623774 | 1/1998 |
| DE | 10033416 | 6/2001 |
| DE | 60026230 | 8/2006 |
| DE | 102005030850 | 1/2007 |
| EP | 0952329 | 10/1999 |

* cited by examiner

*Primary Examiner*—Noah Kamen
(74) *Attorney, Agent, or Firm*—Lucas & Mercanti, LLP; Klaus P. Stoffel

(57) ABSTRACT

A crankcase for an internal combustion engine with two side walls, an upper surface and a first end face, where the side walls, the upper surface, and the first end face are joined with one another as a single piece. The crankcase is open at the second end face, and an adapter flange detachably seals the second end face of the crankcase from the outside environment.

9 Claims, 3 Drawing Sheets

CRANKCASE WITH ADAPTER FLANGE

BACKGROUND OF THE INVENTION

The invention concerns a crankcase for an internal combustion engine.

DE 100 33 416 C1 discloses a rectangular crankcase for an internal combustion engine in a V-arrangement, which consists of two side walls, two end faces, and an upper surface. The crankcase is open on the underside. This crankcase is produced as a one-piece cast aluminum part. A crankshaft space is located inside the crankcase, along with several chambers, which are used as an oil reservoir and for housing auxiliary equipment, for example, pumps and heat exchangers. The underside of the crankcase is sealed from the outside environment with a bottom plate, which seals both the crankshaft space and the other chambers.

The German Patent Application number DE 10 2005 030 850.3, for which a prior printed publication has not yet appeared, discloses a crankcase for an internal combustion engine in series construction, which is open on the underside. Here again, the crankshaft space and an additional chamber are located inside the crankcase. The crankcase is sealed on its underside by a bottom plate, which is larger than the underside of the crankcase. A heat exchanger and a filter are mounted on the projecting length of the bottom plate, i.e., outside the crankcase.

On the power side of the crankcase, a starter generator is mounted, which is operatively connected with the crankshaft and is bolted to the crankcase. If different variants of starter generators are to be built on the same type of crankcase, the manufacturer of the internal combustion engine must provide the different bore patterns for mounting the starter generators. Since the crankcase is established at the beginning of the development process, the manufacturer of the internal combustion engine is already forced at a very early point in time to commit himself to the variants of the starter generators that are to be mounted. Subsequent changes are complicated and expensive, since the casting mold of the crankcase must be changed.

SUMMARY OF THE INVENTION

Therefore, the object of the present invention is to provide a crankcase that allows greater freedom of choice with respect to the starter generators that are to be mounted.

Pursuant to this object, and other which will become apparent hereafter, one aspect of the present invention resides in a crankcase for an internal combustion engine, having two side walls, an upper surface, a first end face, and a second end face. The side walls, the upper surface and the first end face are joined with one another as a single piece. The crankcase is open at the second end face. An adapter flange is detachably mounted to the second end face to seal the second end face from the outside environment.

The crankcase of the invention is open on the second end face. The second end face is sealed from the environment by an adapter flange, which is bolted to the crankcase. Due to the elimination of the wall for the second end face, double-walled construction is avoided with the adapter flange. The entire device is thus made lighter.

The greater freedom of choice is realized by virtue of the fact that, to mount different starter generators on the adapter flange, the corresponding bore patterns have already been realized. The advantage thus resides in the fact that the design of the adapter flange does not have to be finalized until near the end of the development process. Subsequent changes in the adapter flange and exchange are possible, since the bolting of the adapter flange on the crankcase can be undertaken unchanged.

Integrated in the adapter flange are a crankshaft seal, an oil supply channel for an exhaust gas turbocharger, oil return channels with an oil collection point, a receptacle for a rotational speed sensor, and a lead-through for crankcase ventilation. Due to the high degree of integration, the number of parts is further reduced compared to well-known prior-art crankcases. Changes in the crankcase, for example, when changing the type of rotational speed sensor, are not necessary.

Other features and advantages of the present invention will become apparent from the following description of the invention.

DETAILED DESCRIPTION OF THE INVENTION

Figure 1:
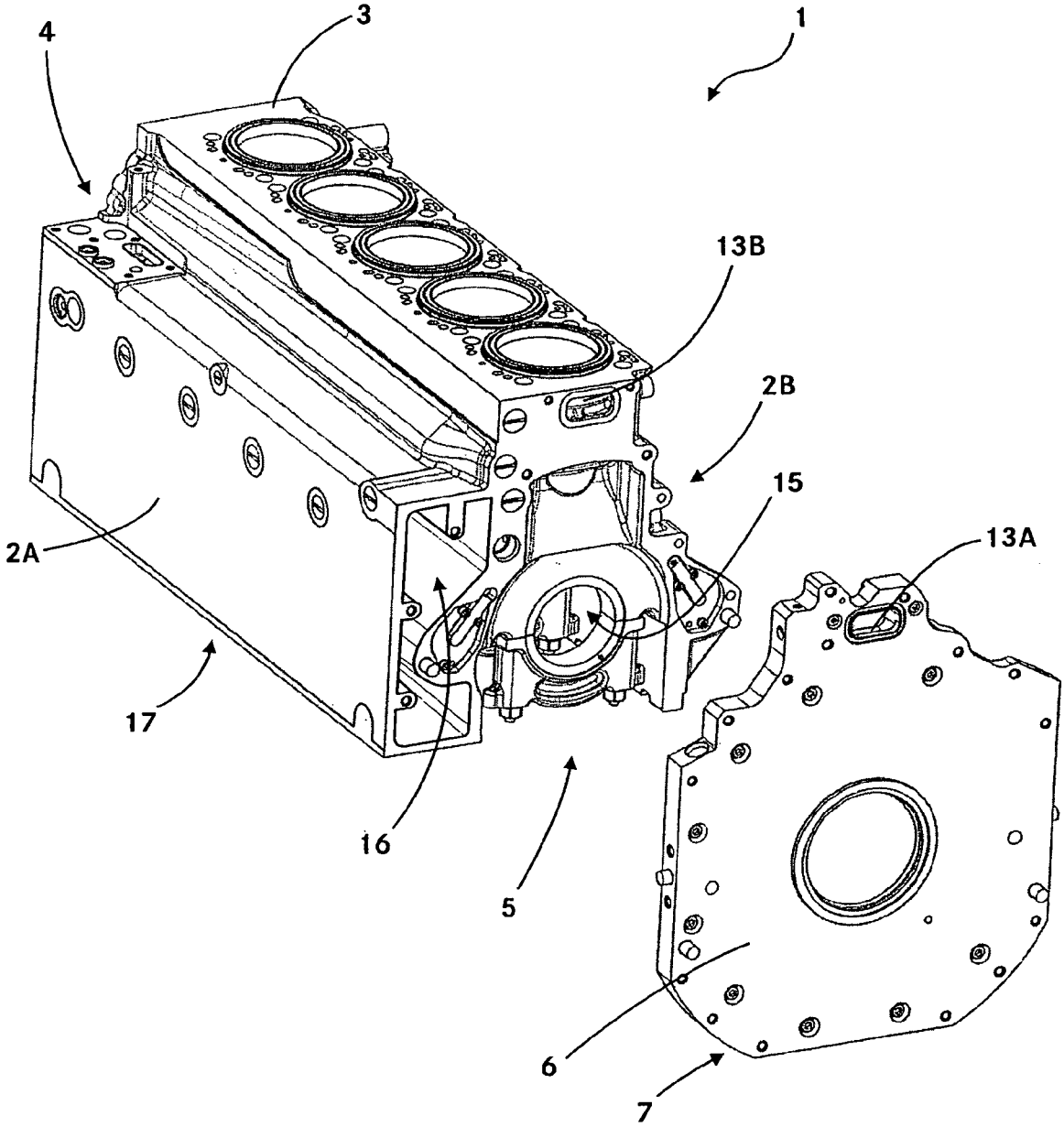
FIG. 1 shows the crankcase with the adapter flange removed.

FIG. 1 shows a 3D view of the crankcase 1 for an internal combustion engine in series arrangement with the adapter flange 6 removed. The adapter flange 6 can also be used in a V-type crankcase, which is disclosed, for example, by DE 100 33 416 C1 and DE 198 55 562 C1. The crankcase 1 consists of two side walls 2A and 2B, a first end face 4, and an upper surface 3. The side walls 2A and 2B, the upper surface 3, and the first end face 4 are cast as a single piece. The crankcase 1 is open on the underside 17. The crankcase 1 is sealed on its underside by a flat bottom plate, which is not shown in the drawing. Oil and water channels are integrated in the bottom plate. The auxiliary equipment, i.e., the pumps, heat exchangers, and filters, are arranged on the upper side of the bottom plate. The crankcase 1 is open at the second end face 5. Therefore, a crankshaft space 15 and a chamber 16 are seen in FIG. 1. The chamber 16 can also serve as an oil reservoir, so that in conjunction with the bottom plate, dry sump lubrication is illustrated.

Figure 3:
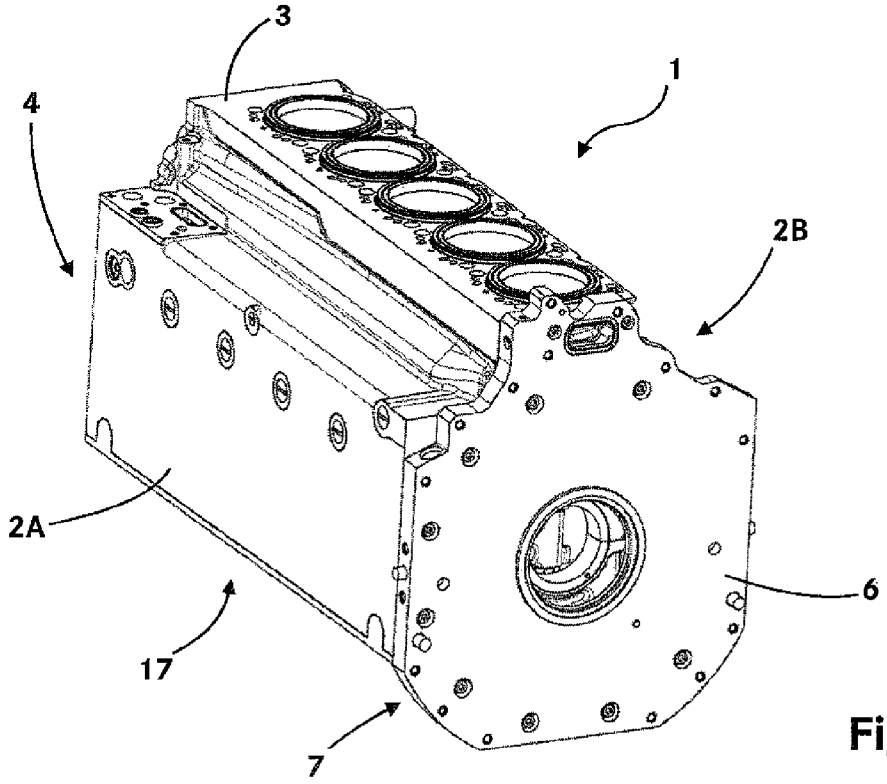
FIG. 3 shows the crankcase with the adapter flange mounted.

The second end face 5 of the crankcase 1 is sealed oiltight from the outside environment by the adapter flange 6. In this regard, see FIG. 3, in which the same reference numbers are used. The drawing shows the crankcase 1 with the adapter flange 6 in its mounted state. In the crankcase 1 illustrated in FIG. 1, the chamber 16 and the crankshaft space 15 are sealed at the second end face 5 by the adapter flange 6. The elimination of double-walled construction in this area results in a weight advantage. Different bore patterns 7 are formed in the adapter flange 6 for mounting different starter generators. This provides the advantage that different starter generators can be mounted on the same adapter flange 6. Integrated in the adapter flange 6 are an oil supply channel for an exhaust gas turbocharger, oil return channels with an oil collection point, a receptacle for a rotational speed sensor, and a lead-through for crankcase ventilation 13A. These are explained in detail in the description of FIGS. 4 and 5.

Figure 2:
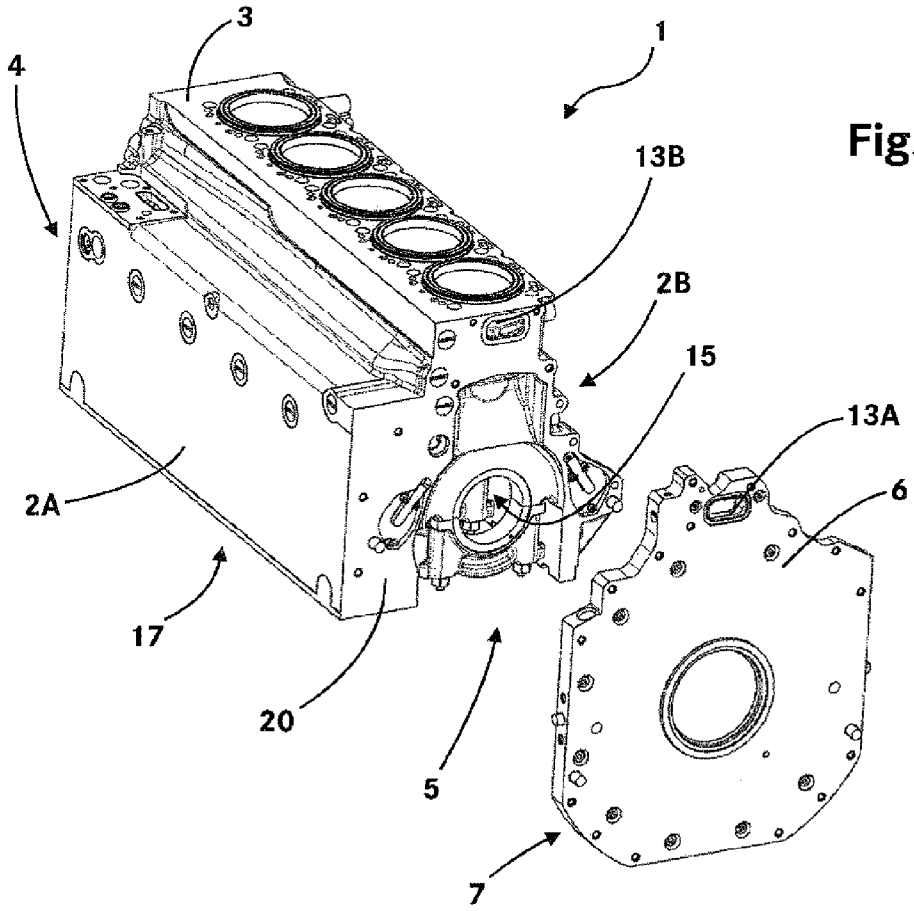
FIG. 2 shows the crankcase with the adapter flange removed and the chamber closed.

The crankcase 1 illustrated in FIG. 2 differs from the crankcase 1 according to FIG. 1 in that the chamber 16 is sealed by its own end wall 20. This solution presents itself whenever the sealing of the end face of the chamber 16 from the side wall 2A and from the bottom plate, a so-called three-surface corner, is critical. The further details are the same as in FIG. 1, so that the discussion in connection with FIG. 1 also applies here.

Figure 4:
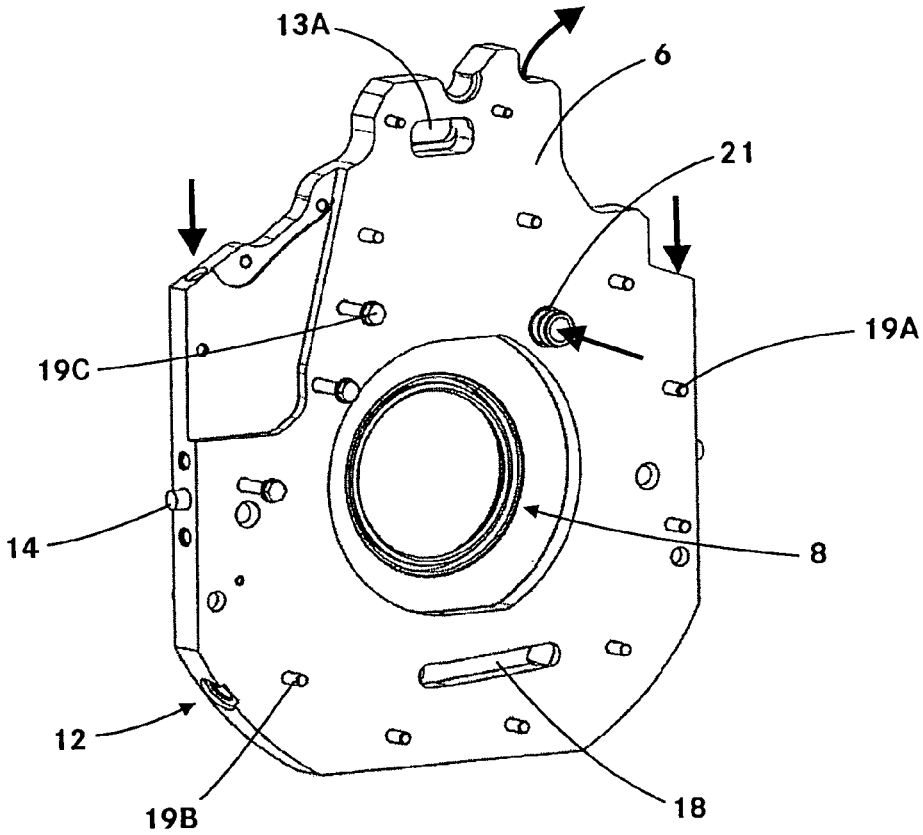
FIG. 4 shows the adapter flange as viewed from the inside.
Figure 5:
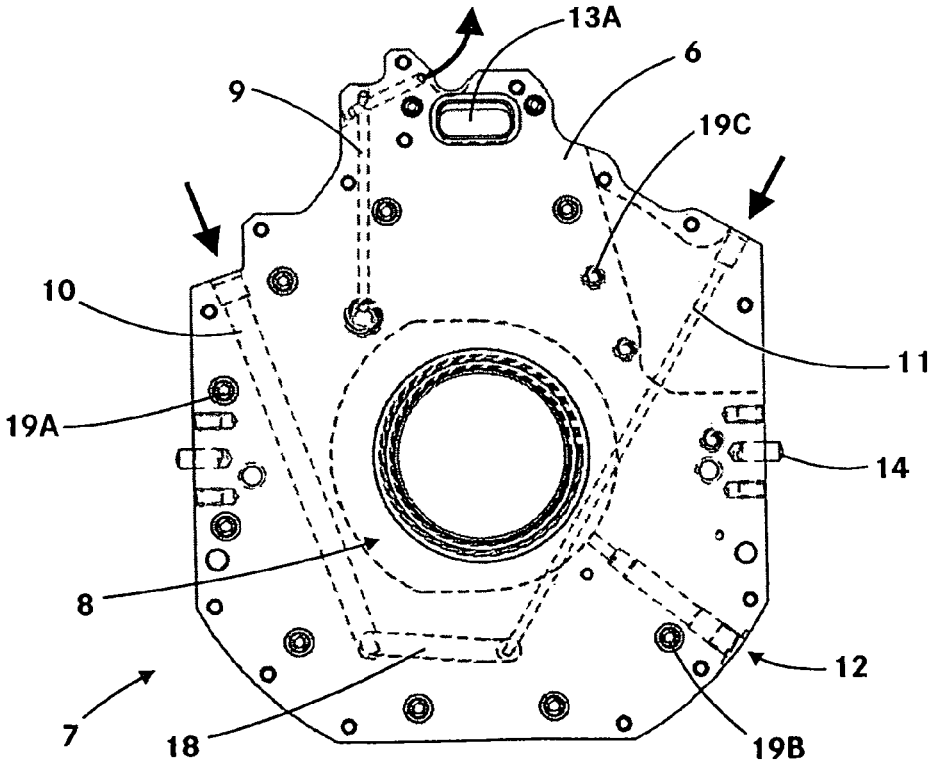
FIG. 5 shows the adapter flange as viewed from the outside.

FIGS. 4 and 5 will be discussed together. FIG. 4 shows the adapter flange 6 as viewed from the inside, i.e., looking out from the second end face 5 of the crankcase 1. FIG. 5 shows the adapter flange 6 as viewed from the outside, with the internal channels drawn with broken lines.

A crankshaft seal 8 is formed on the adapter flange 6, and as a result, a separate cover in addition to a seal for sealing the crankshaft space 15 can be eliminated. Reference number 9 designates an oil supply channel, which is joined with a main oil channel of the crankcase 1 by a plug-in pipe 21 (FIG. 4). The exhaust gas turbocharger is supplied with oil for bearing lubrication through the oil supply channel 9. The flow of oil is indicated by arrows. The oil flows from the exhaust gas turbocharger to an oil collection point 18 through an oil return channel 10 (FIG. 5). From a crankcase ventilation system, the oil likewise flows to the oil collection point 18 through an oil return channel 11 (FIG. 5). The oil collection point 18 in turn communicates with a suction point, which is formed on the bottom plate. The oil is then conveyed from the latter into the chamber 16 by a suction pump. Due to the integration of the two oil return lines 10 and 11 in the adapter flange 6, the corresponding external lines can be eliminated, and this improves operating reliability.

A receptacle 12 for a rotational speed sensor, which detects the rotational speed of the crankshaft, is provided in the adapter flange 6. This has the advantage that a change in the type of rotational speed sensor does not necessitate any changes in the crankcase. For example, if the new rotational speed sensor differs from the previous sensor in its installation dimensions, it is only necessary to match the adapter flange 6 accordingly and then exchange it. Reference number 13A indicates a lead-through for crankcase ventilation, which communicates with a corresponding lead-through 13B in the crankcase 1. In this regard, see FIG. 1.

The adapter flange 6 is bolted to the crankcase 1. To this end, twelve mounting points are provided on the adapter flange 6. In FIG. 4 three mounting points are marked with the reference numbers 19A, 19B, and 19C by way of example. Several lugs 14 are arranged along the outer periphery of the adapter flange 6 to allow the crankcase to be carried.

The following advantages are apparent from the above description:

The adapter flange offers greater freedom of choice with starter generators to be mounted, since it has several bore patterns.

The integration of oil return channels and an oil supply channel make it possible to eliminate the external lines, so that operating reliability is improved.

A receptacle for a rotational speed sensor offers improved freedom of choice with respect to the choice of a sensor.

If there is a change in installation dimensions, the adapter flange can be replaced by a new adapter flange without having to modify the crankcase.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A crankcase for an internal combustion engine, comprising: two side walls; an upper surface; a first end face; a second end face, the side walls, the upper surface and the first end face being joined with one another as a single piece, the crankcase being open at the second end face; and an adapter flange detachably mounted to the second end face to seal the second end face from the outside environment, wherein the adapter flange has bore patterns for mounting different starter generators.

2. The crankcase in accordance with claim 1, wherein a crankshaft seal is formed in the adapter flange.

3. The crankcase in accordance with claim 2, wherein an oil supply channel for an exhaust gas turbocharger is integrated in the adapter flange.

4. The crankcase in accordance with claim 3, wherein an oil return channel of the exhaust gas turbocharger and an oil return channel of a crankcase ventilation system are integrated in the adapter flange.

5. The crankcase in accordance with claim 4, wherein a receptacle for a rotational speed sensor is formed in the adapter flange.

6. The crankcase in accordance with claim 5, wherein a lead-through for the crankcase ventilation system is integrated in the adapter flange.

7. The crankcase in accordance with claim 6, wherein suspension lugs for carrying the crankcase are arranged on the adapter flange.

8. The crankcase in accordance with claim 1, wherein a crankshaft space and at least one additional chamber are arranged in the crankcase, the adapter flange being configured to seal at least the crankshaft space on the second end face, wherein the additional chamber is an oil reservoir.

9. The crankcase in accordance with claim 1, wherein the adapter flange is configured to seal a crankcase in a V-arrangement or in-line construction.

* * * * *